US012687299B2

(12) United States Patent
Owens et al.

(10) Patent No.: US 12,687,299 B2
(45) Date of Patent: Jul. 21, 2026

(54) DECORATIVE FIREPLACE COVERTURE

(71) Applicant: Timothy S. Owens, Overland Park, KS (US)

(72) Inventors: Timothy S. Owens, Overland Park, KS (US); Danielle N. Owens, Overland Park, KS (US)

( * ) Notice: Subject to any disclaimer, the term of this patent is extended or adjusted under 35 U.S.C. 154(b) by 133 days.

(21) Appl. No.: 18/275,669

(22) PCT Filed: Apr. 4, 2022

(86) PCT No.: PCT/US2022/023310
§ 371 (c)(1),
(2) Date: Aug. 3, 2023

(87) PCT Pub. No.: WO2022/178461
PCT Pub. Date: Aug. 25, 2022

(65) Prior Publication Data

US 2024/0102659 A1 Mar. 28, 2024

Related U.S. Application Data

(60) Provisional application No. 63/145,690, filed on Feb. 4, 2021.

(51) Int. Cl.
*F24B 1/192* (2006.01)

(52) U.S. Cl.
CPC ..... *F24B 1/192* (2013.01)

(58) Field of Classification Search
CPC ..... F24B 1/192
USPC ..... 126/544–551; 49/463
See application file for complete search history.

(56) References Cited

U.S. PATENT DOCUMENTS 3,797,172 A * 3/1974 Cannon ..... E06B 7/2316 49/463
4,068,650 A * 1/1978 Nelson ..... F24B 1/1886 126/502
4,157,704 A * 6/1979 Zimmer ..... F24B 13/004 292/202
4,160,442 A * 7/1979 Fox ..... F24B 1/192 D23/405
4,236,499 A * 12/1980 Simeone ..... F24B 1/192 126/547
4,520,791 A * 6/1985 Chamberlain ..... F24B 7/025 126/518
4,562,666 A * 1/1986 Young, III ..... E05B 13/001 49/463
5,301,655 A * 4/1994 Licata ..... F24B 1/192 126/547
6,298,844 B1 * 10/2001 Skinkiss ..... F24B 1/192 126/545

(Continued)

*Primary Examiner* — Vivek K Shirsat

(57) ABSTRACT

The present invention relates to a decorative coverture for a fireplace, and methods of making and using the coverture. Advantageously, the coverture is adjustable to accommodate differently sized or constructed fireplaces. The coverture is designed to reduce or even eliminate unwanted airflow between a room in which a fireplace is located. Further, the coverture is insulated to reduce the heat exchange between the room and the covered fireplace. The coverture comprises two parts: a cover assembly and a bracket assembly that are attached to each other magnetically. When properly installed, the cover assembly and bracket assembly create a tight, insulated seal over an unused fireplace opening.

20 Claims, 4 Drawing Sheets

(56) References Cited

U.S. PATENT DOCUMENTS 6,539,936 B2 * 4/2003 Behn ..... F24B 1/192
126/552
7,849,644 B2 * 12/2010 Melesky ..... E04F 11/062
52/404.1
8,261,736 B1 * 9/2012 Olivarri ..... A47G 5/04
160/369

* cited by examiner

DECORATIVE FIREPLACE COVERTURE

BACKGROUND OF THE INVENTION

A. Field of the Invention

The present invention relates to fireplace covers and covertures. Specifically, the present invention provides compositions for reducing airflow between unused fireplaces and a building's interior, as well as, methods of making and using such covers and covertures.

B. Description of the Related Art

Fireplaces are popular structures in homes because they can provide a source of radiant heat and a cozy ambiance. Further, fireplaces are often considered visual focal points, and the appearance of a fireplace is often a primary concern.

Many fireplaces comprise a fire box with an open front and a flue connected to the top of the fire box which extends through a chimney or an exhaust vent to the exterior. A damper is often located between the fire box and the flue and is intended to block air flow between the fire box and the flue. But many dampers do not provide a good seal, and as a result, unused fireplaces often provide paths for the escape of heated or cooled air from a home. Some fireplaces are equipped with glass doors; however, these glass doors often do not provide an airtight seal either, and the problem of unwanted air flow between the fireplace opening and the interior of the building remains. This problem is particularly apparent when a fireplace is not in use.

Numerous attempts to solve this problem of unwanted airflow between a fireplace and interior space have been made. For example, U.S. Pat. No. 9,371,999 describes a fireplace draft blocker that is made of faux fur, bristles, or soft fabric and is supported by crossed rods that when assembled are bowed and positioned outside and away from the fireplace. U.S. Pat. No. 8,342,166 discloses a decorative fireplace screen that includes a frame, a foam board, and shattered glass pieces that are attached by adhesive and grout and is placed over the fireplace opening. U.S. Pat. No. 6,539,936 describes a decorative removable cover that is attached to a frame that is intended to be placed within the front access opening of a fireplace. U.S. Pat. No. 6,748,943 discloses a flexible, insulated fireplace cover that is held in place with magnets and a barrier member, such as a rubber gasket, around its periphery. U.S. Pat. No. 4,108,145 describes a fireplace closure with an adjustable width. U.S. Pat. No. 3,789,825 discloses a closure device for sealing a fireplace opening that includes a cover member with sealing material along the bottom, side, and top edges of the back of the cover member, a pair of struts, and a pair of "J" shaped springs that hold the device against the walls of the fireplace opening. Each of these fireplace covers has its limitations.

SUMMARY OF THE INVENTION

The present invention provides an improved fireplace coverture that is attractive and acts to reduce or even eliminate drafts that are associated with an unused fireplace. Advantageously, the invention provides an insulated barrier to reduce the loss of heat in cold weather or the introduction of added heat to a cooled space in hot weather. A further advantage of the invention is the elimination of the intrusion of pests, such as insects or birds, through a fireplace opening. The invention also acts as a barrier to prevent small children or pets from investigating an unsanitary environment and to hide an unattractive fireplace interior.

An advantage of the invention's design is that it is suitable for use with a variety of fireplace surrounds and materials. It can be used with most fireplaces that do or do not include doors.

The invention has two parts: a cover assembly and a bracket assembly. When properly installed, the fireplace coverture seals an unused fireplace opening. Advantageously, the fireplace coverture includes an insulating material (insulation) such as polystyrene or a similar product. Those of skill in the art will be aware of a variety of suitable materials. Preferably, the insulation has an insulation value of R-5 or greater. On its front face and visible sides, a cover assembly of the invention can include integrated artwork that resembles traditional fireplace doors to enhance the aesthetic appearance of the invention.

To reduce or eliminate the exchange of air between a fireplace and the surrounding area, the fireplace coverture includes a weatherstripping, or an analogous insulating material, around or adjacent to the back of the cover assembly. Preferably, this weatherstripping helps to ensure an airtight seal around the outer back perimeter of the coverture. Those of skill in the arts will understand that a variety of suitable weatherstripping or insulating materials exist and are suitable for use in the invention.

The back of the cover assembly also includes a magnetic metal that is secured to the cover assembly and is able to achieve a strong magnetic connection to the bracket assembly. Advantageously, by using a magnet the cover assembly can be easily installed or removed from the bracket assembly in a matter of seconds.

The bracket assembly is designed to be installed in most fireplaces, or alternatively for fireplaces that include doors, to the fireplace surround in a matter of minutes. The bracket assembly also is easily removed and is adjustable so that it accommodates different sizes of fireplaces or fireplace surrounds.

The bracket assembly includes a top bracket and a base bracket that are inserted into the fire box or fireplace surround, and when attached to each other, can be easily and quickly extended to the interior height of the fire box or the fireplace surround and fixed at the desired interior height and a desired horizontal depth. Preferred top brackets and base brackets are angle brackets or L brackets. Those of skill in the art will appreciate that either or both the top bracket and base bracket can have different shapes and configurations and achieve the same or similar result. For example, any of a variety of T brackets may be used for either the top or base bracket.

Preferred embodiments of the invention include threaded tension rods. Tension rods can be used for each of the different rods in the invention. Alternatively, suitable locking pins, clamping mechanisms, screws, nuts and bolts, and the like can be used in place of tension rods in the invention. Those of skill in the art will appreciate that a similar result can be achieve by using a wide variety of fasteners or fastening devices. It is only necessary that the chosen fasteners can function to attach the top and base brackets to each other or function to attach the bracket assembly to the interior of a fireplace or a firebox.

Preferred embodiments of the invention are not affixed permanently to a fireplace or a firebox.

In addition, preferred embodiments of the invention include a magnet that is affixed to a rod, preferably a threaded rod or fastener. It is also preferred that the magnet has a flattened outer (or front) face that can adhere to a plate on the back of the cover assembly. A wide variety of suitable magnets, rods, and fasteners are available in the art. It is only necessary that the magnet and rod together can extend from the front of the bracket assembly sufficiently towards the fireplace opening to attach the bracket assembly to the cover assembly. Once installed, the invention provides an efficient, insulated seal on an unused fireplace.

Another advantage of the invention is that it may be repeatedly installed and removed from a fireplace and can be adjusted to fit a number of different sized fireplaces and fireplace surrounds. And, when not in use, the invention can be disassembled for easy storage.

More specifically, the invention provides a fireplace coverture comprising a cover assembly and a bracket assembly. The cover assembly includes a back with a bottom and four sides; a front with a top and four sides; insulation between the back and the front; a plate that is attached to the exterior of the bottom of the back; and weatherstripping. The bracket assembly comprising a base bracket and a top bracket, wherein the base bracket has a short arm and a long arm with an upper opening and a lower opening, and the top bracket has a short arm having an opening in it and a long arm with a slot along its vertical length; an adjustable rod that inserts through the opening in the short arm of the top bracket; a magnet that is attached to a rod, wherein the rod inserts through the slot in the top bracket and the upper opening of the base bracket; and a tension rod that inserts through the slot in the top bracket and the lower opening of the base bracket.

In preferred embodiments, the cover assembly is roughly planar and rectangular in shape. Further, the sides of the front of the cover assembly fit over the sides of the back of the cover assembly such that the front and back of the cover assembly are not easily separated. Those of skill in the art will recognize that the front and back of the cover assembly can be held together using a variety of known materials such as glue, fasteners, a tight fit, or a combination thereof. In a preferred embodiment, the upper perimeter edges of the sides of the back are curved so that the sides of the front fit more easily and snugly over the sides of the back.

It is also preferred that the plate is piece of magnetic metal that is placed near the exterior center of the bottom of the back. Those of skill in the art will appreciate that the entire plate does not need to be metallic. It is only necessary that an area of the plate includes sufficient magnetic metal so that the cover assembly can attach to the bracket assembly.

Those of skill in the art will understand that a variety of materials are suitable for use as insulation in the invention. An exemplary preferred material is polystyrene. Preferred materials are relatively lightweight and rigid.

Preferred embodiments of the invention also include a cover (e.g. an end cap) around the end of the short arm of the base bracket. Those of skill in the art will recognize a variety of covers exist that may be suitable for use in the invention. Preferred covers are those that provide an antiskid function.

Preferred embodiments of the invention further include a threaded tension rod that has a distal end that is flattened. Skilled artisans will appreciate that it is not necessary that the distal end is flattened; however, the bracket assembly can be more easily secured against the ceiling of a fireplace interior or surround when the distal end of the first threaded tension rod is relatively flat. The bracket assembly also can be more easily secured against the ceiling of a fireplace interior or surround when a nut or analogous fastener is placed between the flattened distal end of the first threaded tension rod and the short arm of the top bracket.

Those of skill in the art will appreciate that variety of known screws, rods, and fasteners exist that can be used alone or in combination to effectively substitute for any of the rods in the invention. In practice, it was found that threaded tension rods as described herein worked better than other screws, rods, or fasteners that were considered or tested. It is only necessary that the chosen means of attachment be able to function as described herein. Preferred threaded tension rods include an ergonomic handle or an ergonomically adapted nut as appropriate.

The invention further provides a method of using a fireplace coverture comprising placing a base bracket of a bracket assembly, wherein the base bracket has a short arm and a long arm, in a fireplace with the short arm of the base bracket on the floor of the fireplace and the long arm of the base bracket in a vertical position; attaching a top bracket of the bracket assembly to the base bracket, wherein the top bracket has a short arm and a long arm, by inserting a rod that includes a magnet through a slot in the long arm of the top bracket and through an upper opening in the long arm of the base bracket, and inserting a tension rod through the slot in the long arm of the top bracket and through a lower opening in the long arm of the base bracket; placing an adjustable rod through an opening in the short arm of the top bracket; adjusting the height of the bracket assembly by sliding the top bracket up or down so that the short arm of the top bracket is near the ceiling of the fireplace and the adjustable rod is in contact with the ceiling of the fireplace; tightening the adjustable rod so that the base bracket is held in place against the floor of the fireplace and the top bracket is held in place against the ceiling of the fireplace; tightening the tension rod so that the top bracket and base bracket remain in their adjusted positions; placing a cover assembly, wherein the cover assembly has a back with a bottom and four sides; a front with a top and four sides; insulation between the back and the front; a plate that is attached to the exterior of the bottom of the back; and weatherstripping, at the front of the fireplace; and adjusting the depth of the rod relative to the fireplace opening so that the magnet contacts the plate on the back of the cover assembly.

And, the invention also provides a method of making a fireplace coverture comprising making a cover assembly having a back with a bottom and four sides; a front with a top and four sides, wherein the four sides of the top extend over the four sides of the bottom; insulation between the back and the front; a plate that is attached to the exterior of the bottom of the back; and weatherstripping that is attached around the outer perimeter of the plate or the bottom of the back; and producing a bracket assembly comprising a base bracket and a top bracket, wherein the base bracket has a short arm and a long arm with an upper opening and a lower opening, and the top bracket has a short arm having an opening in it and a long arm with a slot along its vertical length; an adjustable rod that inserts through the opening in the short arm of the top bracket; a magnet that is attached to a rod, wherein the rod inserts through the slot in the top bracket and the upper opening of the base bracket; and a tension rod that inserts through the slot in the top bracket and the lower opening of the base bracket, wherein the magnet adheres to the plate.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description. Further, while specific advantages of the invention are detailed herein, various embodiments may include some, none, or all of these enumerated advantages.

BRIEF DESCRIPTION OF THE DRAWINGS

The following drawings form part of the present specification and are included to further demonstrate certain aspects of the present invention. The invention may be better understood by reference to one or more of these drawings in combination with the detailed description presented herein. Unless specifically noted, articles depicted in the drawings are not necessarily drawn to scale.

DETAILED DESCRIPTION

Figure 1:
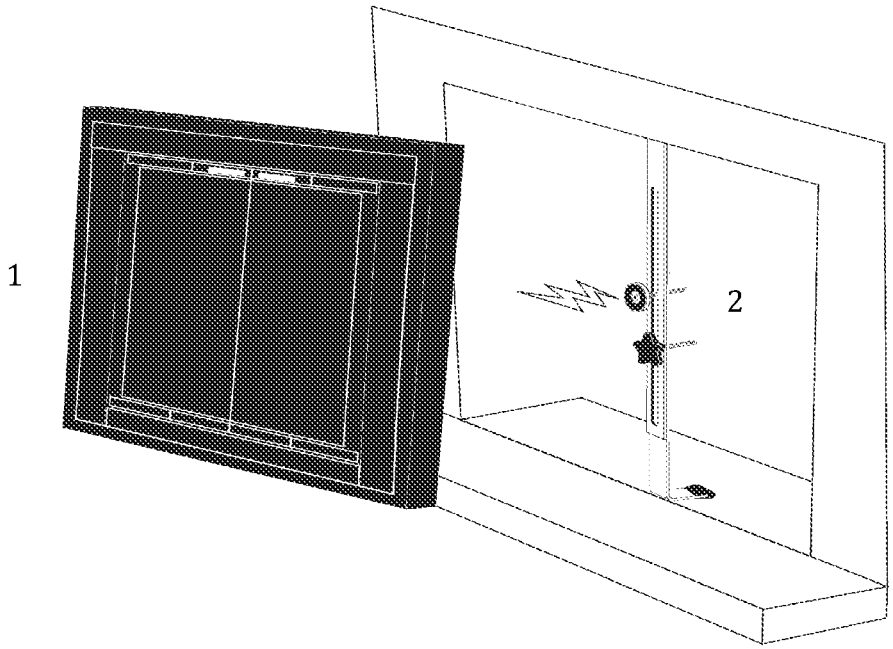
FIG. 1 is a perspective view of an exemplary embodiment with the bracket assembly installed in a fireplace opening and the cover assembly removed.

The invention provides a fireplace coverture comprising a cover assembly 1 and a bracket assembly 2. See FIG. 1. Preferably, the fireplace coverture is decorative and may resemble traditional fireplace doors.

The cover assembly 1 comprises a back 3, insulation 4, a front 5, plate 6, and weatherstripping 7. See FIGS. 3A-4B. The cover assembly 1 is of sufficient size to cover a fireplace opening. Preferably, it is at least slightly larger than the fireplace opening so that when the fireplace coverture is installed, the fireplace opening is effectively sealed and airflow from the room through the fireplace is reduced or even eliminated.

The back 3 is approximately rectangular in shape (i.e. the shape of a fireplace opening) and has a bottom and four sides. In a preferred embodiment, the back includes one or more embossed areas 18. See FIG. 4. The embossed area(s) 18 adds additional strength and structural integrity to the cover assembly 1.

Figure 2A:
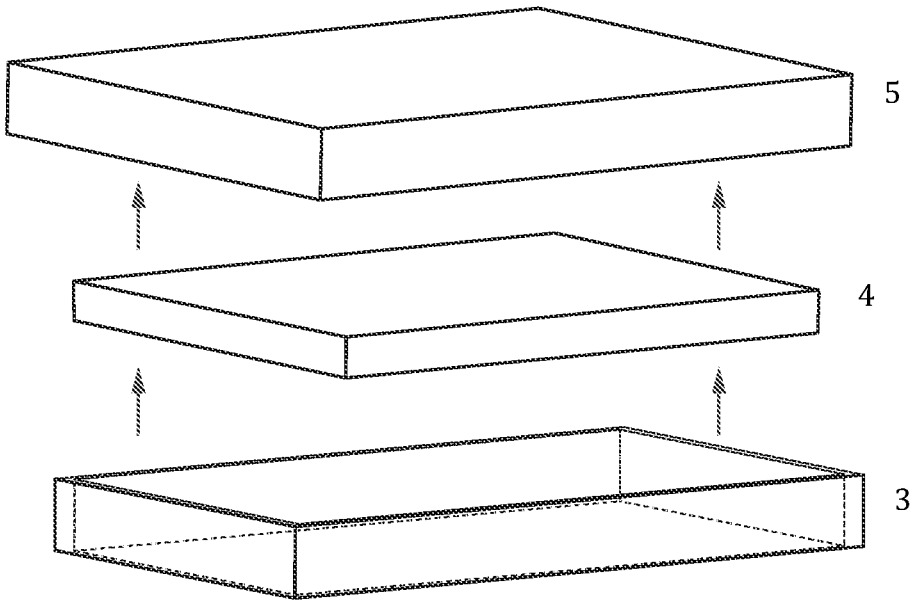
FIG. 2A illustrates a side, perspective, exploded view of an exemplary cover assembly.
Figure 2B:
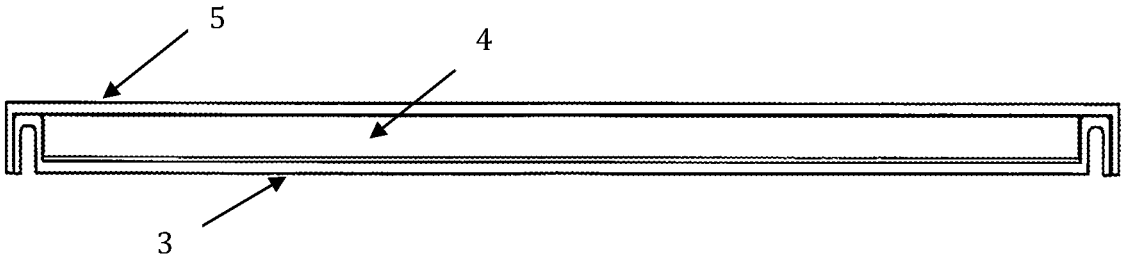
FIG. 2B illustrates a side, cut away view of a fabricated cover assembly.
Figure 3A:
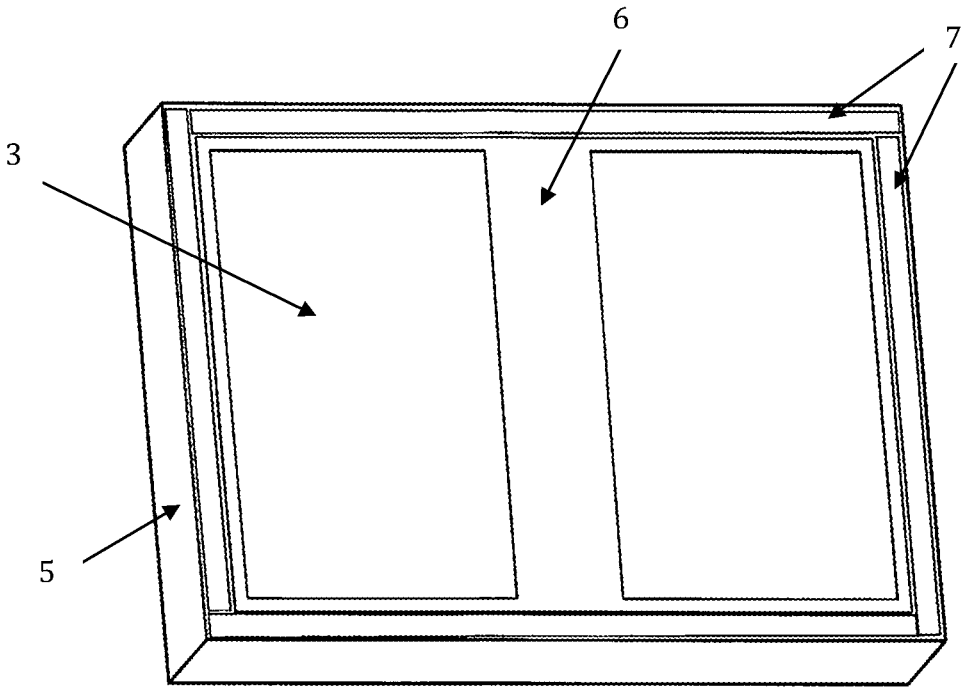
FIG. 3A illustrates a back view of another embodiment of the cover assembly.
Figure 3B:
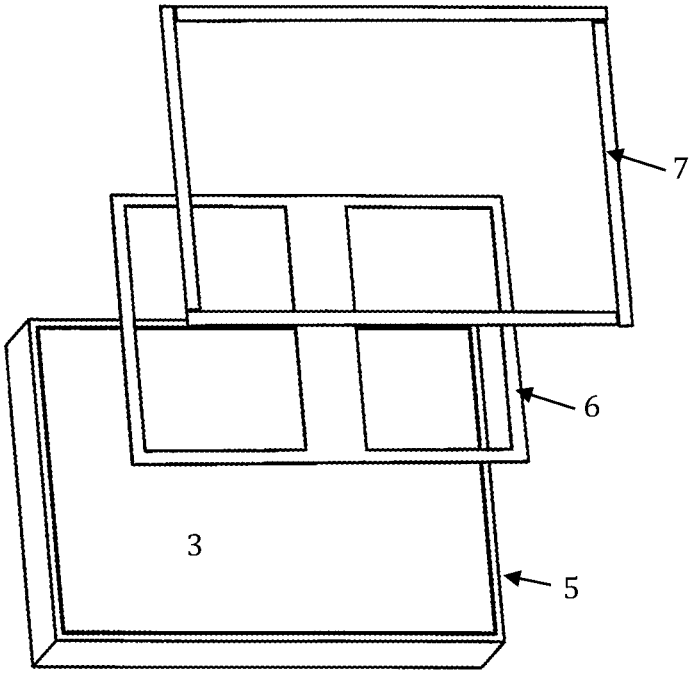
FIG. 3B shows an exploded, perspective view of the same embodiment.

The insulation 4 fits within the interior of the back 3. The front 5 has a top and four sides. Each side of the front 5 fits over a corresponding side of the back 3. The front 5 fits over the back 3, and the insulation 4 is sandwiched between the back 3 and front 5. See FIG. 2B.

Figure 4:
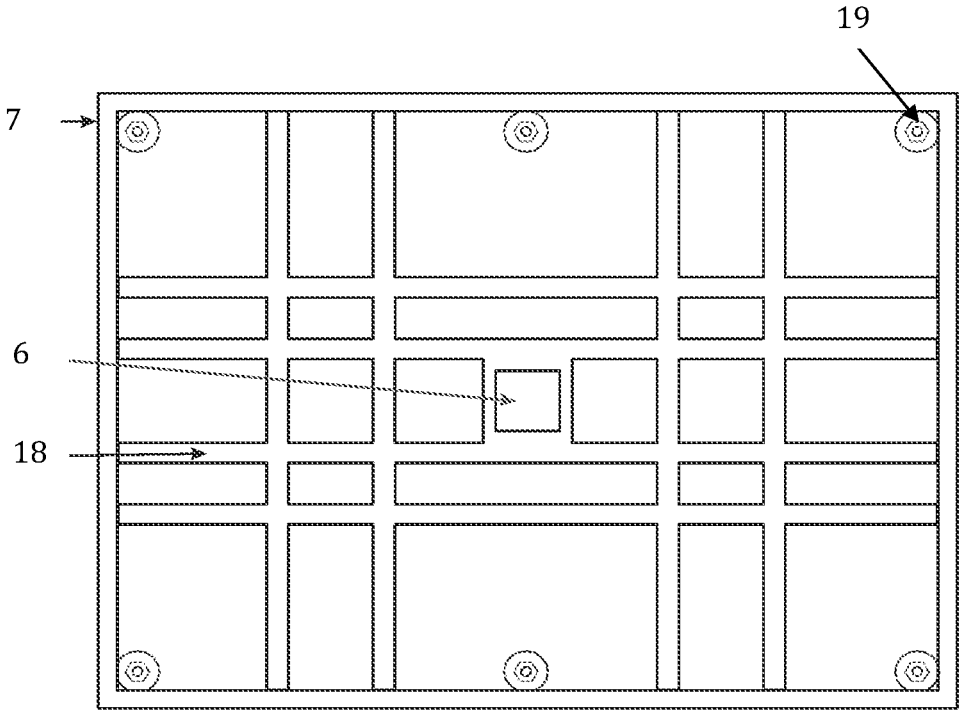
FIG. 4 is a back view of another embodiment of the cover assembly.

Preferably, the front 5 fits snugly over the back 3. The front 5 and back 3 may be attached to one another by a variety of means that are well known in the arts. For example, the front 5 and back 3 may by attached to each other by a variety of fasteners, glues, a snug fit, or a combination thereof. For example, multiple washers, nuts, and screws may be used as illustrated in FIG. 4. It is only necessary that the front 5 and back 3 do not come apart during use to cover a fireplace opening.

The insulation 4 may comprise any known, suitable insulating material. A preferred insulating material will have an approximate insulation value of R-5 or more.

The exterior top of the front 5 can include integrated artwork such as a design that resembles the traditional doors of a fireplace. Alternative designs may be included in the exterior of the top of the front 5.

The exterior of the bottom of the back 3 is attached to a front surface (a first face or front side) of a plate 6. The plate 6 is a relatively thin piece of metal that can adhere to a magnet. This plate 6 can have a variety of shapes and sizes. For example in some embodiments, the plate 6 can match the approximate rectangular shape of the bottom of the back 3. See FIG. 3B. Alternatively, the plate 6 can be relatively small. See FIG. 4. The plate may comprise a variety of metallic materials either alone or in combination with other materials. It may be a solid rectangular sheet or alternatively it may include one or more open spaces. It is only necessary that the plate includes sufficient metallic material so that it can attach to a magnet that is part of the bracket assembly. The back 3 and plate 6 may be attached to one another using any of a variety of suitable means that are well known in the arts. For example, multiple washers, nuts, and screws 19 may be used as illustrated in FIG. 4.

In some embodiments the weatherstripping 7 is attached directly to the back 3 and in other embodiments it is attached to the plate 6. See FIGS. 3A and 4. The weatherstripping 7 is flexible so that when the coverture is installed a tight seal can be established between the cover assembly 1 and the fireplace surround. A variety of materials are known to be used and suitable for weatherstripping. The skilled artisan will be familiar with the variety of suitable ways of attaching weatherstripping to various types of surfaces.

The bracket assembly 2 is adjustable and designed to be installed in most fireplaces. See FIG. 5. Specifically, the bracket assembly comprises a base bracket 8 (e.g. an angle bracket or L bracket) that attaches to a top bracket 9 (e.g. an angle bracket or L bracket). Preferably, the base bracket 8 includes two openings (holes) 11 that are located near the vertical midline of the base bracket 8 such that the upper opening 11 is near the center of the fireplace coverture when the coverture is installed. Both openings are suitable for the insertion of screws, rods, or analogous structures. The lower opening 11 may be located anywhere below the upper opening 11 along the vertical length of the base bracket 8. Preferably, the horizontal arm or short arm of the base bracket 8 has a cover 12 (e.g. an end cap). Preferably, this cover 12 is rubberized or otherwise able to provide an anti-skid surface when positioned on the floor of a fireplace.

Figure 5:
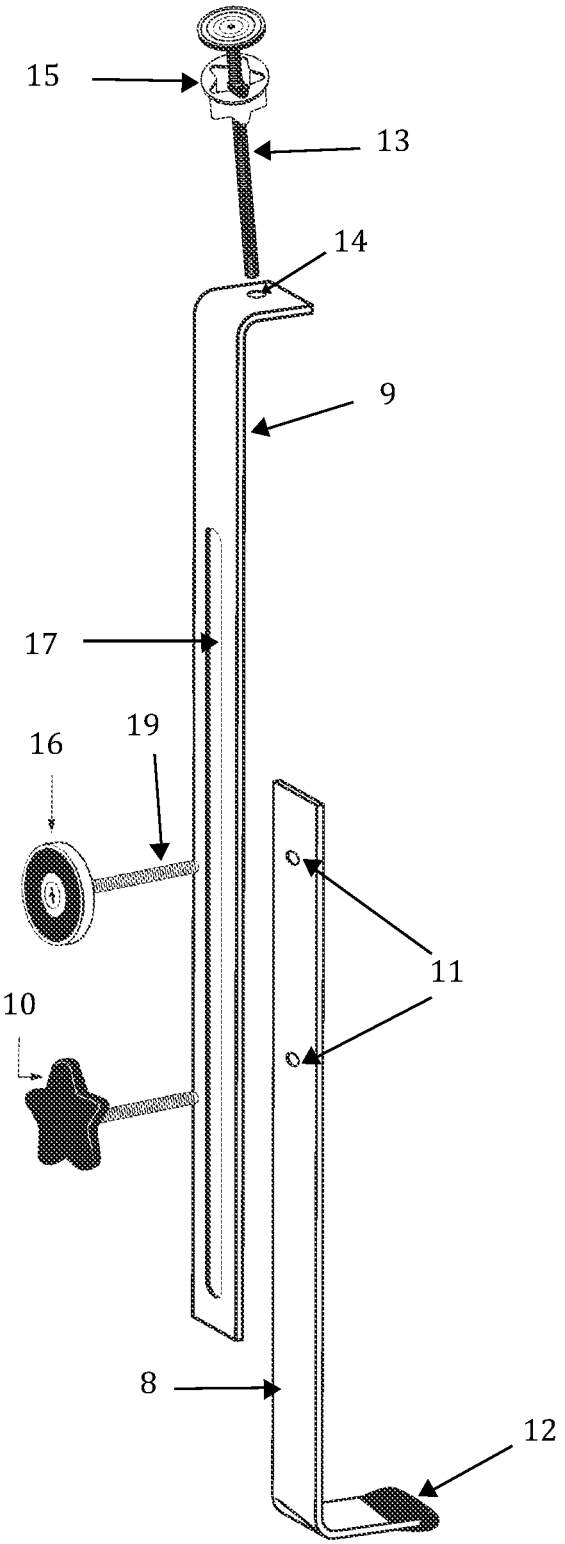
FIG. 5 is an exploded perspective view of a bracket assembly.

The top bracket 9 includes a slot 17 along its vertical length and near its midline. A rod 19 (or screw) that is attached to a magnet 16 and a tension rod 10 are inserted through the slot 17 such that the rod 19 inserts through the upper opening 11, and the tension rod 10 inserts through lower opening 11 of the base bracket 8. Preferably, the rod 19 and magnet 16 are attached to each other permanently to form a single piece or are screwed together as illustrated in FIG. 5.

The top bracket 9 can be moved upward or downward so that the height of the bracket assembly 2 can be adjusted. Preferably, both the rod 19 and the tension rod 10 are threaded. Skilled artisans will appreciate that the rod and tension rod do not necessarily need to be threaded and will recognize that alternatives such as pins, slots, indentations, etc. may be incorporated into either or both. For example, either or both could be a latch with a locking pin or a clamping mechanism.

It is preferred that the magnet 16 has a flat surface that faces that back of the cover assembly 1. It is necessary that the magnet 16 can adhere to the plate 6 on the back of the cover assembly 1.

In the short arm of the top bracket 9 there is an opening 14 through which an adjustable rod 13 is inserted. Preferably, adjustable rod 13 is a threaded tension rod that has a far end that is relatively flat, relatively rigid, and suitable for being pressed against the upper portion of a fireplace's fire box or surround. When installed, adjustable rod 13 is held in place with a fastener 15 such as a nut or other type of fastener. A preferred fastener 15 is an ergonomically friendly fastener. See FIG. 5.

The bracket assembly 2 can be installed in most fireplace fire boxes. Alternatively, if the fireplace includes doors, then the bracket assembly 2 can be installed in front of the doors and within the fireplace surround. The procedure for installing the bracket assembly in a fire box or in front of the doors and within the fireplace surround is similar.

To install the bracket assembly 2, the rod 19 and the tension rod 10 are inserted through the slot 17 of the top bracket 9 and respectively through the upper and lower holes 11 of the base bracket 8. The bracket assembly 2 is placed in the fire box of fireplace surround (or alternatively in front of the fireplace doors) and its height is adjusted so that the cover 12 is against the floor of the fire box or surround and the relatively flat end of the adjustable rod 13 is against the ceiling of the fire box or surround. The adjustable rod 13 is moved up or down so that the bracket assembly 2 is held firmly in place against the fire box or surround. Preferably, the adjustable rod 13 is moved by using the fastener 15, most preferably an adjustable nut.

Once the bracket assembly 2 is firmly in position, the depth of the combination of the magnet 16 and rod 19 is adjusted so that when the cover assembly 1 is put in place, the magnet 16 can adhere to the plate 6 on the back of the cover assembly 1. The tension rod 10 can be tightened so that the magnet 16 remains in the same position relative to the attached cover assembly 1. Preferably, the tension rod 10 includes an ergonomically friendly knob (e.g. a star) or handle for easier adjustment.

Unless defined otherwise, all technical and scientific terms used herein have the same meaning as is commonly understood by one of skill in the art to which this invention belongs at the time of filing. Terminology used herein is for the purpose of describing particular embodiments of the invention and is not intended to be limiting. The meaning and scope of terms should be clear; however, in the event of any latent ambiguity, definitions provided herein take precedent over any dictionary or extrinsic definition. Further, unless otherwise required by context, singular terms shall include pluralities and plural terms shall include the singular unless the content clearly dictates otherwise. Herein, the use of "or" means "and/or" unless stated otherwise. Furthermore, the use of the term "including", as well as other forms such as "includes" and "included" is not limiting. As used herein, "each" refers to each member of a set or each member of a subset of a set. All patents and publications referred to herein are incorporated by reference herein.

It should be appreciated by those of skill in the art that the techniques disclosed in the following examples represent techniques discovered by the inventors to function well in the practice of the invention, and thus can be considered to constitute preferred modes of practice. However, those of skill in the art should, in light of the present disclosure, appreciate that many changes can be made in the specific embodiments which are disclosed and still obtain a like or similar result without departing from the spirit and scope of the invention. Thus, the present invention should not be limited to the exemplary embodiments and techniques illustrated herein.

What is claimed is:

1. A fireplace coverture comprising a) a cover assembly having a back with a bottom and four sides; a front with a top and four sides; insulation between the back and the front; a plate that is attached to the exterior of the bottom of the back; and weatherstripping;

b) a bracket assembly comprising a base bracket and a top bracket, wherein the base bracket has a short arm and a long arm with an upper opening and a lower opening, and the top bracket has a short arm having an opening in it and a long arm with a slot along its vertical length;

c) an adjustable rod that inserts through the opening in the short arm of the top bracket;

d) a magnet that is attached to a rod, wherein the rod inserts through the slot in the top bracket and the upper opening of the base bracket; and e) a tension rod that inserts through the slot in the top bracket and the lower opening of the base bracket.

2. The fireplace coverture of claim 1, wherein the cover assembly is roughly rectangular in shape.

3. The fireplace coverture of claim 1, wherein the sides of the cover fit over the sides of the base.

4. The fireplace coverture of claim 1 further includes a cover over the end of the short arm of the base bracket.

5. The fireplace coverture of claim 1, wherein the adjustable rod has a flattened distal end.

6. The fireplace coverture of claim 1 further includes a fastener between the flattened distal end of the adjustable rod and the short arm of the top bracket.

7. A method of using a fireplace coverture comprising a) placing a base bracket of a bracket assembly, wherein the base bracket has a short arm and a long arm, in a fireplace with the short arm of the base bracket on the floor of the fireplace and the long arm of the base bracket in a vertical position;

b) attaching a top bracket of the bracket assembly to the base bracket, wherein the top bracket has a short arm and a long arm, by inserting a rod that includes a magnet through a slot in the long arm of the top bracket and through an upper opening in the long arm of the base bracket, and inserting a tension rod through the slot in the long arm of the top bracket and through a lower opening in the long arm of the base bracket;

c) placing an adjustable rod through an opening in the short arm of the top bracket;

d) adjusting the height of the bracket assembly by sliding the top bracket up or down so that the short arm of the top bracket is near the ceiling of the fireplace and the adjustable rod is in contact with the ceiling of the fireplace;

e) tightening the adjustable rod so that the base bracket is held in place against the floor of the fireplace and the top bracket is held in place against the ceiling of the fireplace;

f) tightening the tension rod so that the top bracket and base bracket remain in their adjusted positions;

g) placing a cover assembly, wherein the cover assembly has a back with a bottom and four sides; a front with a top and four sides; insulation between the back and the front; a plate that is attached to the exterior of the bottom of the back; and weatherstripping, at the front of the fireplace; and h) adjusting the depth of the rod relative to the fireplace opening so that the magnet contacts the plate on the back of the cover assembly.

8. The method of using a fireplace coverture of claim 7, wherein the short arm of the base bracket has a cover over its end.

9. The method of using a fireplace coverture of claim 7, wherein the adjustable rod is tightened with a fastener.

10. The method of using a fireplace coverture of claim 7, wherein the adjustable rod has a flattened upper end to contact the ceiling of the fireplace.

11. The method of using a fireplace coverture of claim 7, wherein the plate is metallic.

12. The method of using a fireplace coverture of claim 7, wherein the weatherstripping is attached around the outer perimeter of the plate or the bottom of the back.

13. The method of using a fireplace coverture of claim 7, wherein the four sides of the top extend over the four sides of the bottom.

14. The method of using a fireplace coverture of claim 7, wherein the insulation has an insulation value of at least R-5.

15. A method of making a fireplace coverture comprising a) making a cover assembly having a back with a bottom and four sides; a front with a top and four sides, wherein the four sides of the top extend over the four sides of the bottom; insulation between the back and the front; a plate that is attached to the exterior of the bottom of the back; and weatherstripping that is attached around the outer perimeter of the plate or the bottom of the back; and b) producing a bracket assembly comprising a base bracket and a top bracket, wherein the base bracket has a short arm and a long arm with an upper opening and a lower opening, and the top bracket has a short arm having an opening in it and a long arm with a slot along its vertical length; an adjustable rod that inserts through the opening in the short arm of the top bracket; a magnet that is attached to a rod, wherein the rod inserts through the slot in the top bracket and the upper opening of the base bracket; and a tension rod that inserts through the slot in the top bracket and the lower opening of the base bracket, wherein the magnet adheres to the plate.

16. The method of making a fireplace coverture of claim 15 further includes a fastener to tighten the adjustable rod.

17. The method of making a fireplace coverture of claim 16 further includes a cover over the short arm of the base bracket.

18. The method of making a fireplace coverture of claim 16, wherein the plate is metallic.

19. The method of making a fireplace coverture of claim 16, wherein the insulation has an insulation value of at least R-5.

20. The method of making a fireplace coverture of claim 16, wherein the adjustable rod has a flattened upper end.

* * * * *